United States Patent [19]

Kosmatka et al.

[11] Patent Number: 5,039,904

[45] Date of Patent: Aug. 13, 1991

[54] MOUNT FOR MINIATURE ARC LAMP

[75] Inventors: Walter J. Kosmatka, Highland Heights; Douglas G. Seredich, Montville; John J. Biel, Chesterland; William O. Harris, East Cleveland; Jeffrey D. Johnson, Mentor, all of Ohio

[73] Assignee: General Electric Company, Schenectady, N.Y.

[21] Appl. No.: 413,816

[22] Filed: Sep. 28, 1989

[51] Int. Cl.[5] ..... H01J 5/58

[52] U.S. Cl. ..... 313/318; 313/49; 313/113; 362/267; 362/306

[58] Field of Search ..... 313/318, 49, 113; 362/267, 306

[56] References Cited

U.S. PATENT DOCUMENTS

| | | | |
|---|---|---|---|
| 1,611,651 | 12/1926 | Leavitt | 313/318 |
| 3,256,383 | 6/1966 | Sasorov | 313/318 |
| 4,470,104 | 9/1984 | Cox | 362/211 |
| 4,496,873 | 1/1985 | Bedu et al. | 313/318 |
| 4,607,192 | 8/1986 | Billing et al. | 313/318 |
| 4,754,373 | 6/1988 | Otto et al. | 362/61 |
| 4,774,645 | 9/1988 | Iwamoto | 362/226 |
| 4,795,939 | 1/1989 | Eckhardt et al. | 313/318 |
| 4,810,932 | 3/1989 | Ahlgren et al. | 313/579 |

FOREIGN PATENT DOCUMENTS

| | | | |
|---|---|---|---|
| 155672 | 9/1985 | European Pat. Off. | 313/318 |

*Primary Examiner*—Donald J. Yusko
*Assistant Examiner*—Michael Horabik
*Attorney, Agent, or Firm*—Edward M. Corcoran; Stanley C. Corwin; Fred Jacob

[57] ABSTRACT

A mount for a minature lamp terminating at one end in an elongated tubular member, said mount comprising a base and a cap assembled in mating engagement and exerting a compressive force on at least one deformable, elastomeric tubular or ring shaped member in said mount which surrounds and contacts said tubular lamp member of which at least a portion of which is inserted in a bore in the mount, thereby holding the lamp in the mount.

27 Claims, 7 Drawing Sheets

MOUNT FOR MINIATURE ARC LAMP

BACKGROUND OF THE INVENTION

1. Field of the Invention

The present invention relates to a mount for an electric lamp having an elongated tubular portion. More particularly, the present invention relates to an electrically non-conductive mount for a miniature arc discharge lamp having an elongated tubular portion, said mount comprising a base and a cap assembled in mating engagement for exerting a force on at least one deformable elastomeric sleeve or ring shaped member. Still more particularly, the present invention relates to a lamp and mount assembly, said mount comprising a base and a cap assembled in mating engagement and said lamp comprising a miniature metal halide arc discharge lamp having an elongated tubular portion which is held in a bore in said mount by means of at least one elastomeric member therein which is compressed around said tubular lamp portion by cooperation between said base and said cap.

2. Background of the Disclosure

There is much interest in the automobile industry in using tungsten-halogen and arc lamps as the light sources for automotive headlamps. Tungsten-halogen lamps are presently used, but arc lamps have potentially longer life, higher light output and the size of arc lamps, such as metal halide arc discharge lamps, required for such lighting applications is relatively small, thereby enabling automotive manufacturers a greater leeway in innovative automotive design. Tungsten-halogen lamps presently employed for automotive lighting in standard replaceable or sealed beam headlamp units are generally welded to formed wires or posts which are then soldered or brazed to the lamp reflector through electrical feed-through members. Federal regulations are very stringent with regard to strength requirements for lamp sources for replaceable or composite lamps. Accordingly, such lamps are usually retained to a fixture by means of a strap member which is then welded to a metal member for the purpose of focusing and retaining the lamp in the base and in the reflector. U.S. Pat. No. 4,470,104 discloses a means for mounting a tungsten-halogen lamp wherein the lamp, due to temperature and other considerations is held in place by metal members. Still another means for mounting a tungsten halogen lamp in an automotive type lamp assembly is disclosed in U.S. Pat. No. 4,754,373 in which the lamp is held in place by metal members proximate to the lamp.

In contrast to tungsten-halogen lamps, arc discharge lamps, such as metal halide arc discharge lamps, require extremely high starting voltages, usually in the range of 10,000 to 20,000 volts. Because of these high voltages, it is necessary to electrically isolate the hot lead wire which exits the quartz or glass lamp envelope. Additionally, some of these lamp designs require very high starting frequencies in the order of 50 kHz in order to initiate the arc and at high frequencies metallic parts in the proximity of the hot lead wire tends to increase the capacitance of the system. The result of this increased capacitance is to decrease the level of voltage delivered to the lamp for the purpose of initiating the arc. Further, corona discharge sometimes occurs between the hot lead and metal parts proximate to the lamp or hot lead. Accordingly, it is desirable to limit the capacitance of the system by removing all but absolutely essential metallic elements from around the lamp. The use of metallic straps around the arc tube or in general proximity to the arc or high voltage lead would reduce the ability of the lamp to start and require higher voltages and more expensive electronics for starting a lamp in order to compensate for capacitance losses.

Still another phenomena which complicates the use of a scheme for supporting a metal arc discharge lamp relates to sodium loss from the arc chamber. Most arc tubes require compounds of sodium and one or more halogens to enhance their efficiency. Under certain conditions sodium ions can migrate through the quartz or high temperature glass arc chamber walls and the corresponding loss of sodium in the lamp results not only in hard starting or failure to start but darkening of the lamp envelope. Sodium migration out of the arc chamber also seems to be enhanced by the presence of metals near the arc chamber. This is a well known phenomenon in the lamp industry and larger metal halide lamps are designed to avoid or minimize the presence of metal near the arc chamber.

SUMMARY OF THE INVENTION

The present invention relates to an electrically non-conductive mount for electric lamps having an elongated tubular portion, wherein said elongated tubular portion is held in a bore in the mount by means of at least one elastomeric member. More particularly, the present invention relates to an electrically non-conductive mount for an electric lamp having an elongated tubular portion, said mount comprising a base and a cap assembled in mating engagement and exerting a compressive force on at least one elastomeric tubular or ring shaped member contained in a bore in said mount. In another embodiment the present invention relates to a lamp and mount assembly wherein said mount comprises a base and a cap assembled in mating engagement and exerting a compressive force on at least one tubular or ring shaped elastomeric member contained in a bore laterally extending through said mount and wherein said lamp comprises a miniature electric lamp having a vitreous envelope at least one end of which terminates in an elongated tubular portion which extends through at least a portion of said bore and is held therein by said elastomeric member. In a preferred embodiment at least two elastomeric members will be employed. Lamps suitable for use with this invention include incandescent type lamps such as the well-known tungsten-halogen lamps and metal halide arc discharge lamps. Means for producing arc lamps and filament containing incandescent lamps such as tungsten-halogen lamps useful in the practice of this invention, and particularly relatively small lamps, have been disclosed, for example, in U.S. Pat. No. 4,810,932 the disclosures of which are incorporated herein by reference. In this patent a method is disclosed for producing arc lamps and double-ended tungsten-halogen incandescent lamps blown from a single piece of lamp tubing and having at least one elongated tubular end.

The elongated tubular portion of the lamp extends through at least a portion of the bore extending through the mount and through the elastomeric members contained in said bore. The lamp is retained in the mount by a combination of friction and a radially compressive force exerted on the tubular portion resulting from cooperation of said base and cap in exerting a compressive force on the elastomeric member(s) surrounding and contacting the elongated tubular portion of the lamp in the mount bore. One of the lead wires of the lamp, and preferably the hot lead, passes through the elongated tubular portion of the lamp in the mount and is connected to a source of electricity. The other lead wire is grounded.

The present invention provides a facile assembly of a lamp in a mount and eliminates the need for the use of adhesives to hold the lamp in place in the mount. The lamp and mount assembly can be fabricated and tested rapidly, thereby eliminating machine and or assembly positions and associated costs and floor space requirements. Use of elastomeric compression members compensates for variations in the lamp tube with respect to being out-of-round and permits greater variance in the tube diameter without requiring additional parts. Employing two or more elastomeric members, and preferably separated by at least one spacer, also provides excellent stability for the lamp due to the resulting holding of the lamp tube in the bore at two different points.

DETAILED DESCRIPTION

Figure 1A:
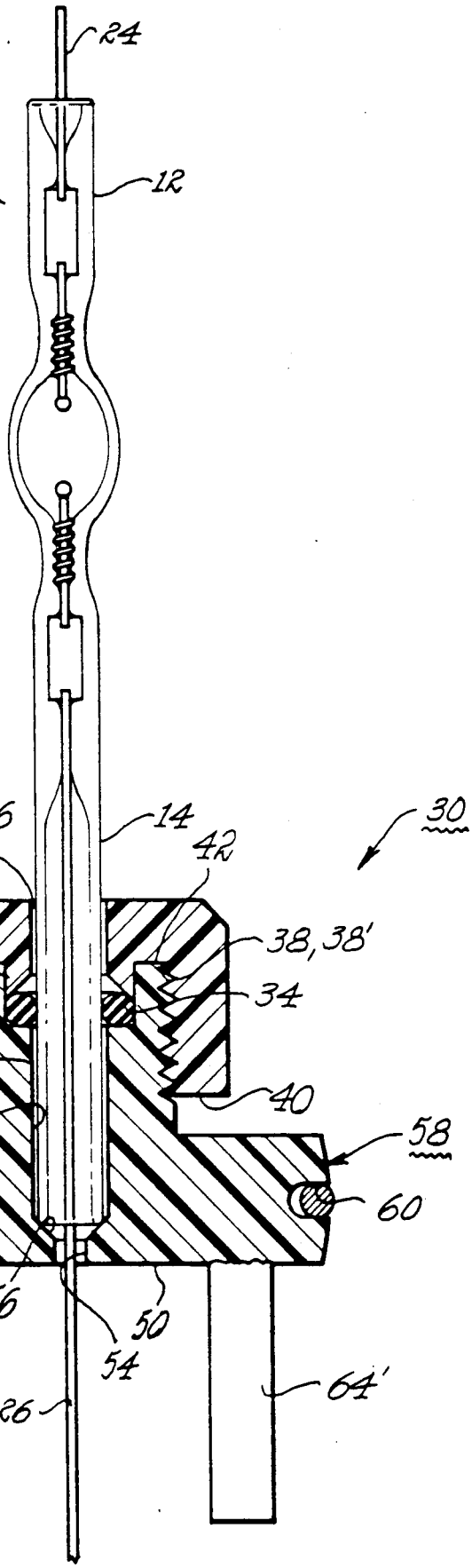
FIGS. 1(*a*) and 1(*b*) illustrate an embodiment of the present invention in cross-section and in plan view wherein one end of an arc discharge tube terminates in an elongated tubular portion which is held in a bore extending through the mount by means of an O-ring.
Figure 1B:
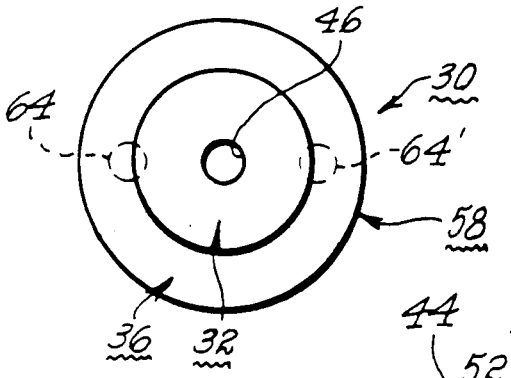

Referring now to FIG. 1(*a*), there is shown arc lamp 10 comprising arc discharge tube 12 having an elongated tubular portion 14 supported in mount 30. Mount 30 comprises an internally threaded, cup-shaped screw cap 32 which screws onto base 36, thereby compressing O-ring 34 which exerts an inward radial force on lamp tube 14 to secure lamp 10 in mount 30. Cap 32 has an internally threaded first bore 38 axially extending from open end 40 to end wall 42 for matingly engaging with the externally threaded portion 38' of base 36. End wall 42 has a bore 46 axially extending from the top 44 of said cap into said first bore 38, being coaxial with said first bore, having a diameter smaller than said first bore and extending from end wall 42 partially into said first bore as the inner wall of a cylindrical boss 48 having an outer diameter smaller than the inner diameter of bore 38. Base 36 comprises a generally tubular body having an axially aligned bore 51 within, extending between the top 52 and bottom 50 ends of said base, said bore having a diameter at the top end portion larger than the diameter of said bore at mid portion 52, with a diameter at the bottom portion 54 being smaller than the diameter of said mid portion, and with a coniform shaped portion 56 joining said mid portion and bottom portions of said bore. The bottom portion of said base 36 is in the shape of a flange 58 which, in the embodiment depicted, is barrel shaped and contains a circumferential groove 60 extending around the outer periphery which contains a ferromagnetic element 62, generally in the form of a split ring whose ends may or may not overlap and which fits into groove 60. Elastomeric compression member 34 illustrated in the Figure as an O-ring is fitted around and contacts said lamp tube 14 and is compressed by screwing cap 32 onto base 36, thereby holding said lamp in place in said mount 30. More than one elastomeric member or O-ring may be used, if desired. Further, the elastomeric member may be in the form of a sleeve or tube instead of an O-ring. The inner diameters of bores 46 and 52 of cap 32 and base 36, respectively, will preferably be larger than the outer diameter of lamp tube 14 by an amount sufficient to avoid physical contact between said lamp tube and inner walls of said bores, except at the coniform portion 56 of base 36. Although the embodiment in FIG. 1 is shown with cap 32 having internal threads which matingly engage with external threads of base 36, other suitable means may be employed for securing the cap on the base, such as an annular projection or wedge (not shown) on base 36 at a point along the threaded portion shown in the Figure, with a corresponding mating groove (not shown) circumferentially around the inner portion of bore 38 on cap 32 for a snap fit. Still other means for fastening cap 32 onto base 36 may be employed, if desired. Legs 64 and 64' molded as part of base 36 aid in inserting the lamp and mount assembly into the rear of a reflector and adjusting the assembly so that the optical center of the lamp is at the focal point of the reflector before the assembly is bonded, RF welded or otherwise permanently attached to the reflector. FIG. 1(*b*) is merely a simplified plan view of mount 30 looking down from the top.

Figure 2A:
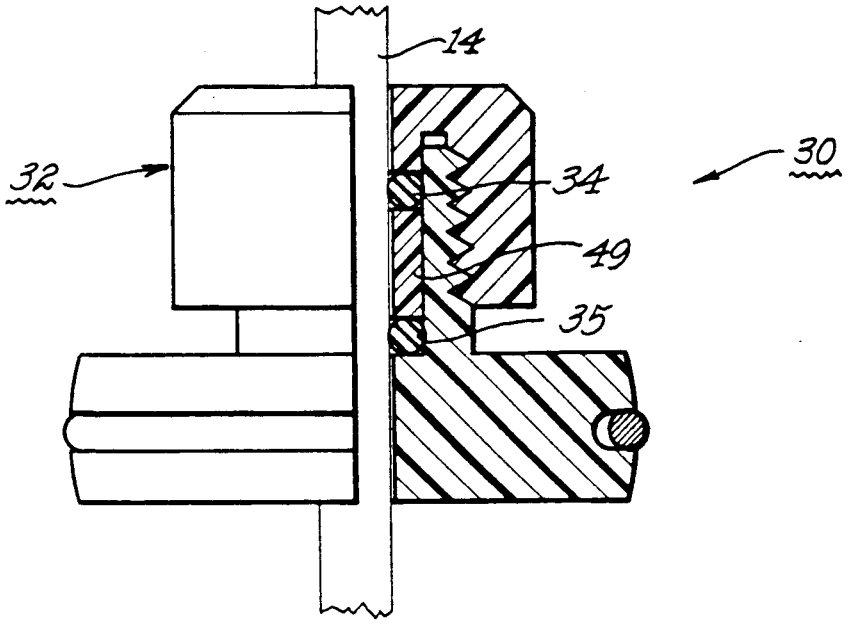
FIGS. 2(*a*) and 2(*b*) illustrate other embodiments of the type of lamp mount illustrated in FIGS. 1(*a*) and 1(*b*).
Figure 2B:
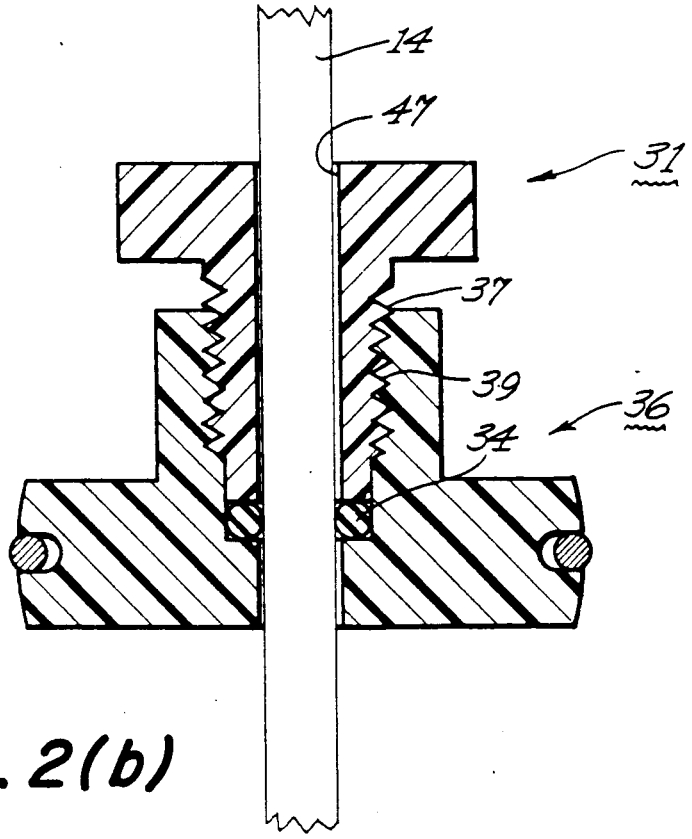

FIG. 2(*a*) illustrates another embodiment of mount 30 in partial cut away form wherein cap 32 does not possess an inwardly extending cylindrical portion for compressing the O-ring. Instead, sleeve 49 performs the function of compressing the O-ring. In this embodiment a second O-ring 35 is depicted in addition to O-ring 34. In yet another embodiment, a threaded sleeve having external threads may be employed as the cap member of the mount as shown in FIG. 2(*b*). Thus, FIG. 2(*b*) illustrates a cap 31 as an externally threaded sleeve having a bore 47 extending therethrough for receiving lamp tube 14. Cap 31 threads into base 36, which is now internally threaded at 39, to compress O-ring 34. In both of the embodiments shown in FIG. 2, the bore in the base portion 36 may terminate in a coniform portion as depicted in FIG. 1(*a*) so that the elongated tubular portion of the lamp terminates in the base.

Arc lamps having vitreous silica (quartz) envelopes generally operate at inner envelope wall temperatures of about 750°–900° C., whereas tungsten-halogen lamps having high temperature glass envelopes operate at about 300°–700° C. Accordingly, in one embodiment base 36 will be made of an electrically non-conductive plastic material capable of being molded or machined and having sufficient heat resistance to be able to be used with the present invention without being distorted or melted from the heat emitted by the arc and also conducted from the arc chamber of the lamp by the lamp tube 14. Suitable high temperature resistant plastics include materials such as teflon, polysulfones, liquid crystal polymers, such as Vectra A130 by Celanese Corporation, polyetherimides such as Ultem by GE and polyphenylene sulfides such as Supec by GE and Ryton by Philips. The compression member(s) in the form of one or more sleeves or O-rings 34 may be made of a material such as a silicone rubber or Teflon elastomer which are flexible and resistant to high temperatures. In the embodiments shown in FIGS. 1 and 2, the O-ring(s) also act to retard conduction of heat down into the bore of the base, thereby permitting the use of a plastic for the base which may be less heat resistant than cap 32. Cap 32 or threaded sleeve 31 may also be made of an electrically non-conductive ceramic or glass material. The presence of a ferromagnetic ring or element 62 on the flanged portion of the base shown in FIGS. 1 and 2 enables one to (i) insert the lamp and mount assembly into a thermally deformable, plastic nose or socket portion of a reflector, as illustrated in FIG. 2(*a*), so that the outer portion of ring 62 contacts the inner plastic surface of the reflector socket, (ii) adjust the position of the lamp and mount assembly in the reflector socket to insure that the lamp is positioned with its optical center coinciding with the focal point of the reflector, and then applying a radio frequency electrical field around the ring thereby inducing electrical current in it and causing heating of the ring. The plastic material in circumferential groove in the flanged portion of the base and the plastic in the inner portion of the reflector socket will melt or deform where they are contacted by the ferromagnetic ring, thereby forming a tight, immovable connection of the lamp in appropriate alignment with the focal point of the reflector upon cooling. Such radio-frequency or or RF plastic welding is well known to those skilled in the art having been employed in the plastics industry for many years and employing a ferromagnetic element for forming a coupling means between the base portion of a lamp mount and a plastic socket of a reflector is disclosed, for example, in U.S. Pat. No. 4,795,939.

Figure 3:
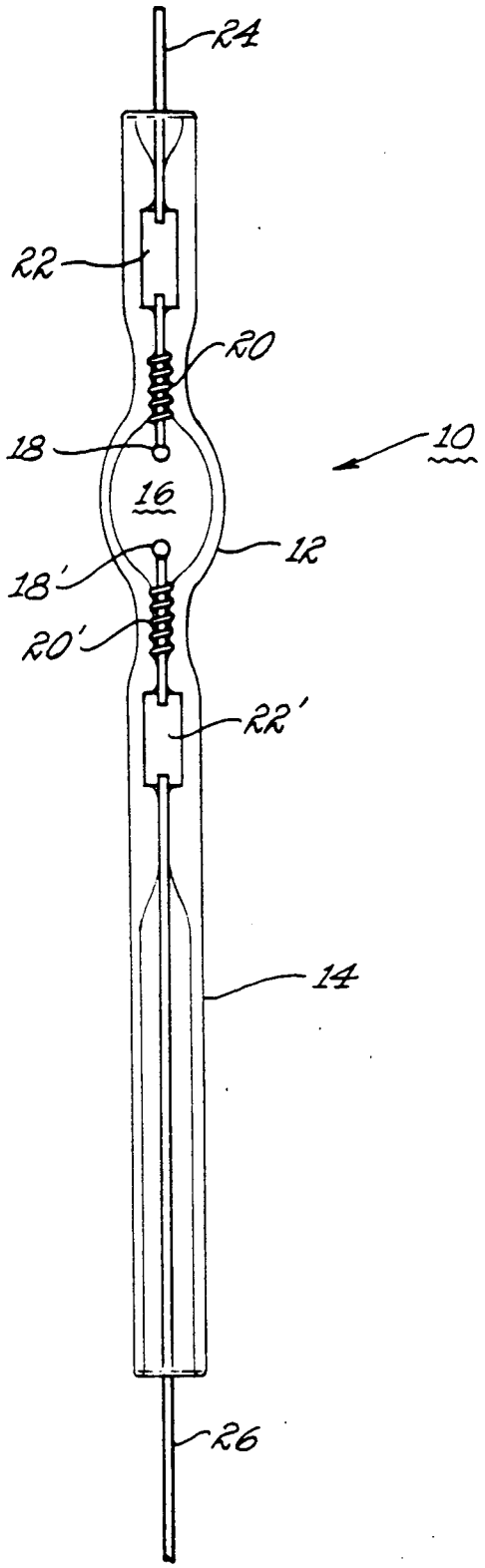
FIG. 3 is a cross-sectional illustration of an arc tube having an elongated tubular portion suitable for use with the present invention.

FIG. 3 schematically illustrates a particular type of miniature metal halide arc discharge lamp that has been successfully employed in the practice of the present invention. Means for manufacturing such a lamp having an elongated tubular portion as depicted, are known to those skilled in the art and may be found in U.S. Pat. No. 4,810,932 the disclosures of which are incorporated herein by reference. Turning now to FIG. 3, lamp 10 is illustrated comprising vitreous envelope 12 made of quartz having an elongated tubular portion 14. The lamp has an arc chamber 16 containing electrodes 18 and 18' hermetically sealed therein by means of a shrink seal around molybdenum foil members 22 and 22' to which the electrodes are welded. Centering coils 20 and 20', made out of a suitable high temperature material such as tungsten, provide a more precise axial alignment of the electrodes within the arc chamber than would otherwise be possible. Top projecting lead wire 24 is connected to the other end of molybdenum foil seal 22 and bottom projecting lead wire 26, which is the high voltage or hot lead, is connected to foil 22' and projects through and exits through lamp tube 14 for connection to a source of voltage.

Figure 4:
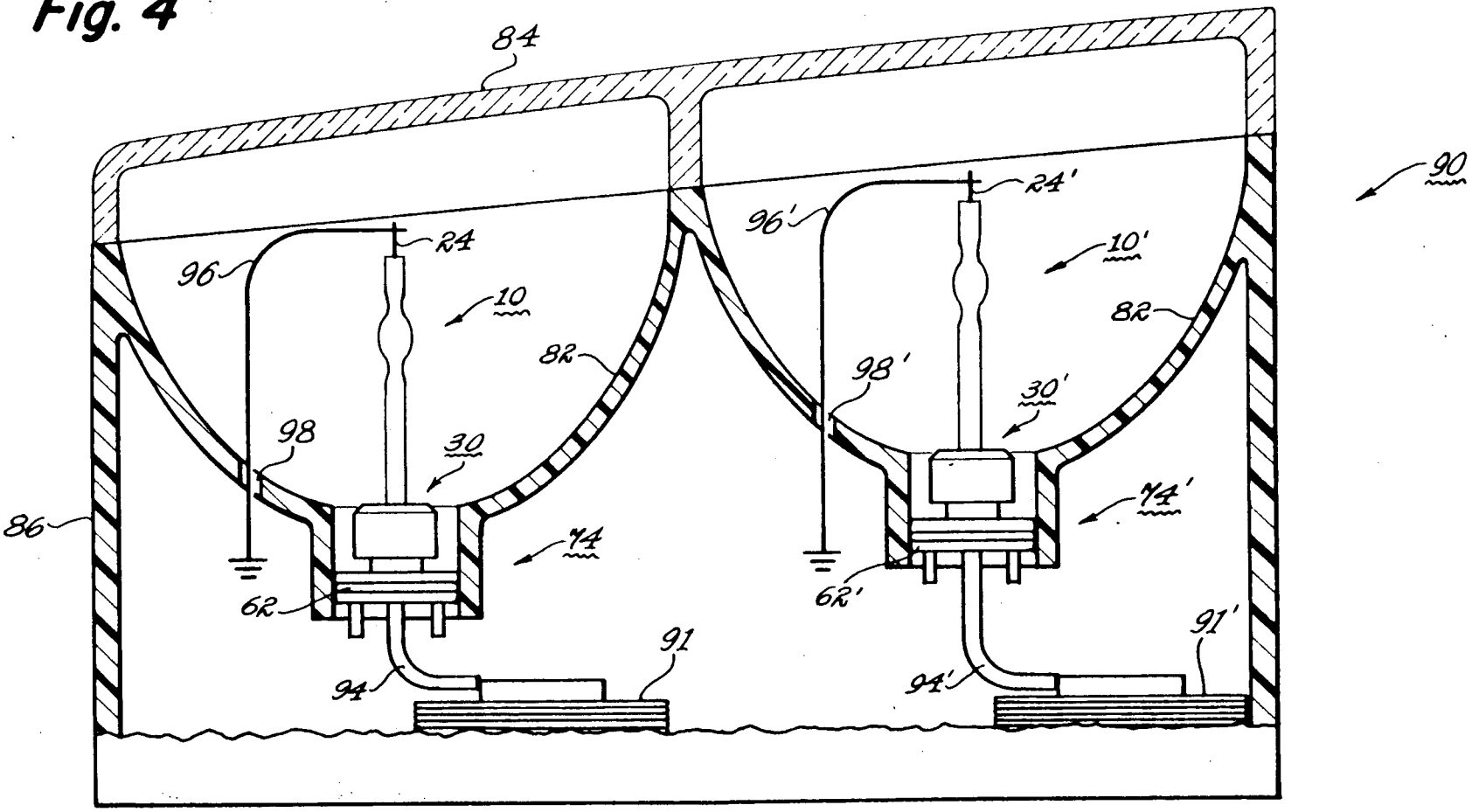
FIG. 4 illustrates the lamp and mount assembly of FIGS. 1(*a*) and 1(*b*) retained in a reflector portion of an automotive lighting unit.

FIG. 4 schematically illustrates a lamp and mount assembly of the type illustrated in FIGS. 1 and 2 assembled into a compound reflector structure having associated therewith an integrated housing containing suitable electronic components for starting and operating the lamp which is suitable for use in an automotive lighting system. Thus, lamps 10 and 10' supported in mounts 30 and 30' are secured in an all-plastic automotive forward lighting structure 90 having parabolic reflecting surfaces 82 and 82' and rearwardly protruding cylindrical sockets or nose portions 74 and 74' into which the assembled lamp and mount structures are inserted, aligned to insure that the optical center of lamp 10 is at the focal point of the reflector and secured by means of applying a high-frequency (rf) electrical field to ferromagnetic elements 62 and 62'. Insulated conductors 94 and 94' are attached at one end to lamp leads 26 and 26' (not shown) and at the other end to the high voltage tranformers 91 and 91'. Ground leads 24 and 24' protruding from the top of lamps 10 and 10' are welded to extension leads 96 and 96' which exit through a suitable opening 98 and 98' towards the rear of reflector 90. Plastic rear housing 86 is integrally molded to the reflector portion by suitable means and contains electronics for starting and operating lamps 10 and 10'. Lens 84 is hermetically sealed to the unit.

Figure 5:
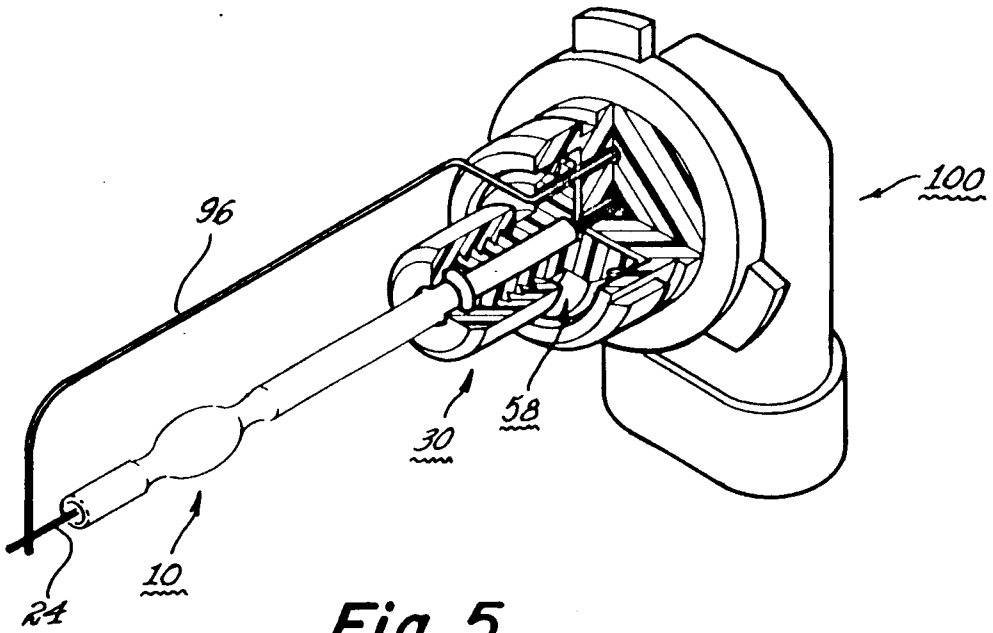
FIG. 5 is a perspective view in partial cut-away section of an arc tube held in a mount in accordance with an embodiment of the present invention.

FIG. 5 illustrates a section through a perspective view of an embodiment of the present invention wherein lamp 10 is assembled into a mount 30 as shown in FIG. 1(*a*), wherein the flanged portion 58 of the base is attached to a cantilevered mount structure 100 for attachment to a lamp reflector. Mount 30 is secured into structure 100 by an adhesive, by RF welding employing a ferromagnetic ring or combination thereof. Extension lead 96 is welded to ground lead 24 of lamp 10 and passes through the lamp mount 30 and cantilevered structure 100 where it is connected to an electrical ground. Such cantilevered lamp mount structures and their use with reflectors for automotive lighting application are well known to those skilled in the art and an illustrative, but non-limiting example may be found in U.S. Pat. No. 4,774,645.

Figure 6:
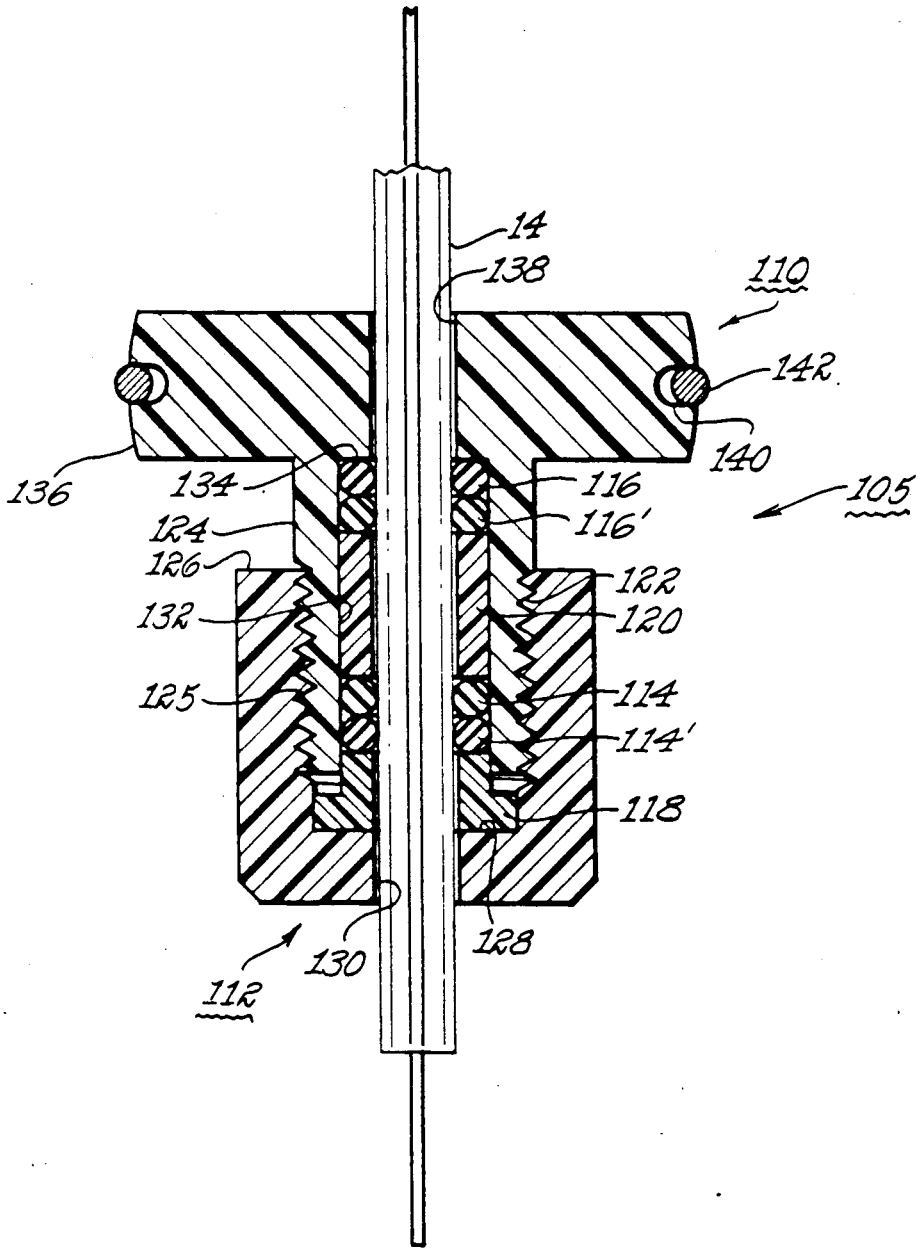
FIG. 6 illustrates another embodiment of a lamp and mount assembly according to the invention wherein the lamp tube is secured by four O-rings in a bore extending through the mount.

Referring to FIG. 6 there is shown tubular portion 14 of lamp 10 (not shown) supported in mount 100. Mount 100 comprises base 110 which has a tubular portion 124 open at one end and terminating at the other end in a flange 136 having a bore 138 which is coaxial with and smaller in diameter than bore 132 onto which is screwed or snapped cap 112 which compresses O-rings 114, 114' and 116, 116' by means of bushings 118 and 120, thereby exerting an inward radial force on tubular 14 and an outwardly radial face on tubular portion 132 which secures the lamp in the mount. In the embodiment shown, cap 112 is cup-shaped and has an internally threaded bore 122 for matingly engaging with external threads 125 on tubular portion 124 of base 110. In cap 112, bore 122 extends axially from open end 126 to interior end wall 128 at the other, partially closed end. Bore 130 in the partially closed end of cap 112 is coaxial with bore 122 and with bore 132 in tubular portion 124 of base 110 to permit a portion of tube 14 to pass through said partially closed end of cap 112. When cap 112 is screwed, snapped or otherwise secured onto base 110, end wall 128 exerts an axial force on bushing 118 which, in turn, exerts an axial compressive force on O-rings 114, 114', bushing 132 and O-rings 116, 116' which is resisted by end wall 134 of base 110, said O-rings thereby exerting an inward radial compressive force on tube 14 for securing the lamp in the mount. In the embodiment shown, the use of a pair of O-rings on each end of bushing 120 results in an airtight or hermetic seal. Internal end wall 134 of flange 136 of base 110 cooperates with cap 112 in producing the axial compressive force exerted on the O-rings located inside of bore 132. Base 110 has said tubular portion 124 which is open at one end, with the other end terminating in a flanged portion 136 having a bore 138 coaxial with bore 132, said bore 138 extending completely through said flanged portion for receiving said lamp tube 14. In the embodiment shown, flanged portion 136 is axially barrel shaped around its outer periphery with groove 140 extending around said periphery and containing a ferromagnetic element 142, generally in the form of a split ring whose ends may or may not slightly overlap (depending on the RF frequency employed), for welding mount 110 into a heat deformable plastic socket extending rearward of a lamp reflector as is shown in FIG. 7(*a*) in partial cutaway view.

Figure 7A:
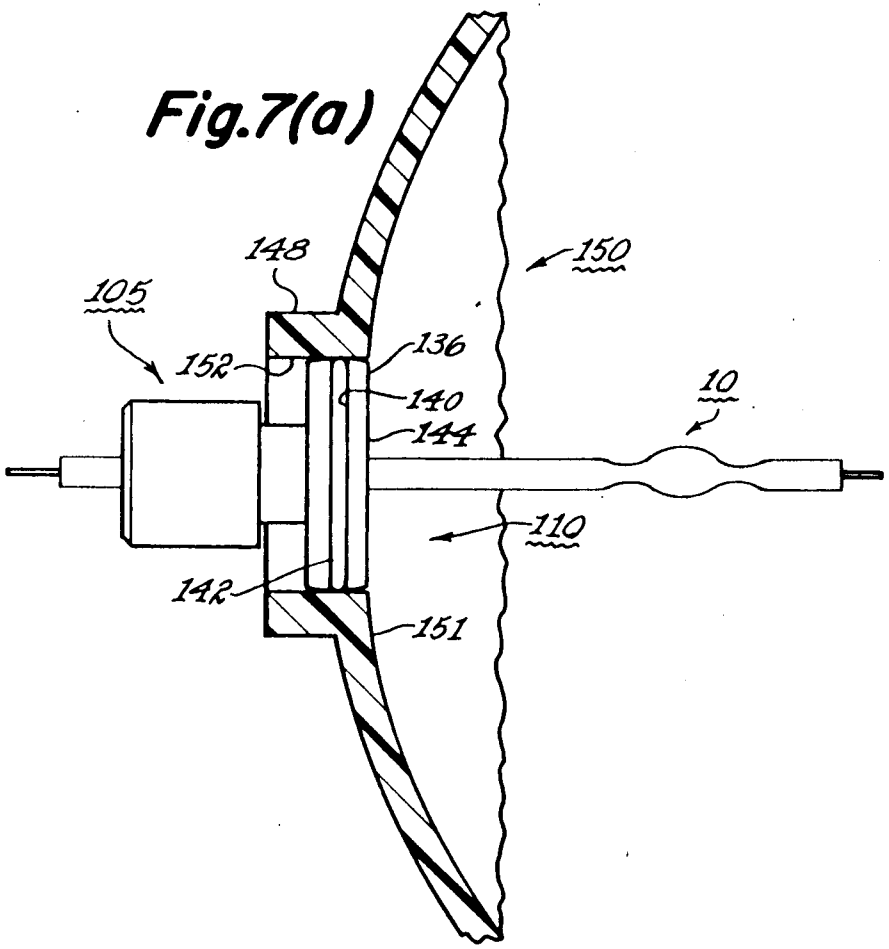
FIG. 7(*a*) and 7(*b*) illustrate a method of securing the assembly of FIG. 6 in a lamp reflector.
Figure 7B:
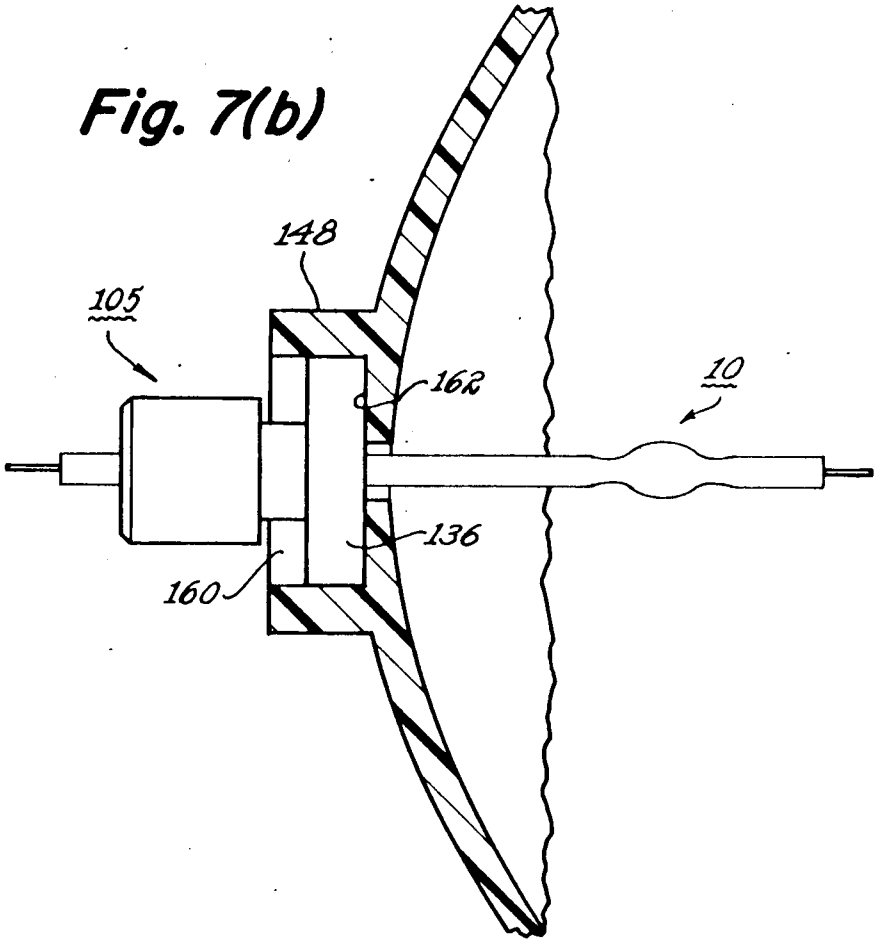

Thus, turning to FIG. 7(*a*) mount 100 containing lamp 10 is shown in reflector socket 148 of plastic reflector 150 which is shown in partial or cutaway form. In this embodiment, the lamp and mount assembly are inserted into plastic socket 148 which protrudes rearwardly from reflector 150. Thus, the lamp 10 and mount 100 assembly are inserted into reflector socket 148, the lamp 10 is energized and the position of mount 100 adjusted so that the center of the arc or other light source is at the optical or focal center of reflector 150. A radio frequency (RF) electromagnetic field is applied around ferromagnetic ring 142, thereby inducing electric current in the ring and heating it so that it slightly melts at least a portion of the plastic on both the inner surface of groove 140 in flange 136 of mount 110 and inner wall 152 of socket 148, thereby bonding mount 100 to socket 148. This bond may be sufficient to serve as a permanent bond or, if desired, a suitable adhesive, bonding, or sealing material may subsequently be introduced into the interior of socket 148 to form a stronger bond between the mount 100 and the interior of the socket and/or to hermetically seal the lamp and mount assembly into the socket. It is preferred that the topmost surface 144 of flange 136 be substantially flush with the interior, reflecting surface 151 of the reflector 150. In one embodiment surface 144 will have a light reflective coating.

FIG. 7(*b*) illustrates another embodiment wherein flange 136 of mount 100 is inserted into cavity 160 formed by shoulder 162 in socket 148. In this embodiment the use of ferromagnetic ring 142 is optional and is left to the discretion of the practitioner. Instead, flange 136 may seat into cavity 160 touching shoulder 162 a suitable adhesive compound may be used to secure mount 100 into socket 148. Thus, ferromagnetic ring 142 may be dispensed with and the outer or peripheral surface of flange 136 may be flat instead of barrel shaped. In this embodiment, the dimensions and assembly of the lamp, mount and reflector are more critical since this configuration does not permit alignment of the lamp within the reflector. It has been found that the reflector socket, mount and lamp have to be dimensioned precise enough for the optical center of the lamp to be within the focal point of the reflector. This has been found to be within about 10% of the length of the arc in the lamp. For automotive lamps, this arc length will be about 2 to 3 mm.

The foregoing illustrations of the invention are not intended to limit it to use with arc lamps. Filament lamps of the type disclosed in U.S. Pat. No. 4,810,930 may also be employed in the practice of this invention, in which case the mount need not be made entirely of electrically non-conductive material.

We claim:

1. A lamp mount made of electrically non-conductive material and comprising a base and a cap, with said cap assembled onto said base in mating engagement therewith, said base and said cap each having a first bore axially extending therethrough and coaxial with each other for receiving a tubular portion of a lamp, with said base or said cap further having a second bore coaxial with and in communication with said first bore and containing at least one tubular or ring shaped compression member, said base and said cap cooperating in exerting a compressive force on said compression member when said mount is assembled so that said compressive member exerts a radial compressive force on said tubular portion of said lamp for securing said lamp in said mount.

2. The mount of claim 1 wherein the inner diameter of said first and second bores is greater than the outer diameter of said tubular lamp portion.

3. The mount of claim 2 wherein said compression member is made of an elastomeric material.

4. The mount of claim 3 wherein said base has a flange shaped portion.

5. The mount of claim 4 wherein said flange shaped portion has a circumferential groove around the outer diameter thereof which contains a ring shaped member made of a ferromagnetic metal.

6. The mount of claim 5 having at least two elastomeric compression members.

7. The mount of claim 4 having at least two elastomeric compression members.

8. The mount of claim 6 wherein said cap and base screw onto each other.

9. The mount of claim 7 wherein said said cap and base screw onto each other.

10. In combination, a lamp and lamp mount assembly wherein said lamp comprises an electric lamp having a vitreous envelope containing an arc chamber within and wherein at least one end of said lamp terminates in an elongated tubular portion and wherein said mount comprises a base and a cap made of electrically non-conductive material and assembled in mating engagement, said base and said cap each having a first bore longitudinally extending therethrough and coaxial with each other which contains at least a portion of said tubular portion of said lamp, with said base or said cap further having a second bore coaxial and in communication with said first bore which contains at least one tubular or ring shaped elastomeric compression member therein which circumferentially surrounds and contacts at least part of said elongated tubular lamp portion, said lamp being retained in said mount by a combination of friction and radial compressive forces exerted on said tubular portion by said compression member resulting from cooperation of said base and said cap in exerting compressive force on said compression member.

11. The assembly of claim 10 having at least two compression members present in said second bore.

12. The assembly of claim 11 wherein said base has a flange shaped portion.

13. The assembly of claim 12 wherein at least two compression members separated from each other by a spacer in said second bore are employed in said bore to hold said lamp in said mount.

14. The assembly of claim 13 wherein said flange shaped portion has a circumferential groove around its outer portion which contains a ring shaped member made of a ferromagnetic material.

15. In combination, a plastic reflector having a reflecting surface and a rear portion protruding rearwardly from said reflecting surface with an electric lamp and lamp mount assembly mounted in said rear portion, said lamp having a vitreous envelope at least one end of which terminates in an elongated tubular portion, wherein said mount comprises a base and a cap assembled in mating engagement with each other, said base and said cap each having a first bore axially extending therethrough and coaxial with each other which contains at least part of said tubular portion of said lamp, with said base or said cap further having a second bore coaxial and in communication with said first bore which contains at least one tubular or ring shaped elastomeric compression member therein which circumferentially surrounds and contacts at least part of said elongated tubular lamp portion, said lamp being retained in said mount by a combination of friction and radial compressive forces exerted on said tubular portion by said compression member resulting from cooperation of said base and said cap in exerting compressive force on said compression member.

16. The combination of claim 15 wherein said mount is made of electrically non-conductive material.

17. The combination of claim 16 wherein said tubular lamp portion in said mount does not contact the interior surface of said bores in said mount.

18. The combination of claim 17 wherein said base portion of said mount has a flange shaped portion.

19. The combination of claim 18 wherein said base is made of a thermally deformable plastic.

20. The combination of claim 19 wherein said flange shaped portion has a circumferential groove around its outer portion which contains a ring shaped member made of a ferromagnetic material.

21. The combination of claim 20 wherein said mount contains at least two compression members separated from each other by a spacer in said second bore which hold said lamp in said mount.

22. In combination, a lamp and lamp mount assembly wherein said lamp comprises an electric lamp having a vitreous envelope enclosing a filament within a filament chamber, wherein at least one end of said lamp terminates in an elongated tubular portion and wherein said mount comprises a base and a cap assembled in mating engagement, said base and said cap each having a first bore longitudinally extending therethrough and coaxial with each other which contains at least a portion of said tubular portion of said lamp, with said base or said cap further having a second bore coaxial and in communication with said first bore which contains at least one tubular or ring shaped elastomeric compression member therein which circumferentially surrounds and contacts at least part of said elongated tubular lamp portion, said lamp being retained in said mount by a combination of friction and radial compressive forces exerted on said tubular lamp portion by said compression member resulting from cooperation of said base and said cap in exerting compressive force on said compression member.

23. The assembly of claim 22 having at least two compression members present in said second bore.

24. The assembly of claim 23 wherein said base has a flange shaped portion.

25. The assembly of claim 24 wherein at least two compression members separated from each other by a spacer in said second bore are employed in said bore to hold said lamp in said amount.

26. The assembly of claim 25 wherein said flange shaped portion has a circumferential groove around its outer portion which contains a ring shaped member made of a ferromagnetic material.

27. The assembly of claim 26 wherein said tubular lamp portion in said mount does not contact the interior surface of said first bores in said mount.

* * * * *